US005916452A

United States Patent [19]

Kobayashi et al.

[11] Patent Number: 5,916,452

[45] Date of Patent: Jun. 29, 1999

[54] PROCESS FOR THE PRODUCTION OF AN INK JET HEAD

[75] Inventors: Junichi Kobayashi, Ayase; Shoji Shiba, Sagamihara; Toshiaki Hirosawa, Hiratsuka; Toru Yamane, Yokohama, all of Japan

[73] Assignee: Canon Kabushiki Kaisha, Tokyo, Japan

[21] Appl. No.: 08/567,534

[22] Filed: Dec. 5, 1995

[30] Foreign Application Priority Data

Dec. 5, 1994 [JP] Japan ..... 6-300719
Jun. 8, 1995 [JP] Japan ..... 7-141606

[51] Int. Cl.[6] ..... B41J 2/05; B44C 1/22

[52] U.S. Cl. ..... 216/27; 347/65; 156/155; 264/261; 264/254

[58] Field of Search ..... 347/42, 63, 65; 216/27, 36; 156/305, 155; 264/261, 254, 255

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,775,445 | 10/1988 | Noguchi | 156/637 |
| 5,030,317 | 7/1991 | Noguchi | 156/630 |
| 5,332,466 | 7/1994 | Nozawa | 156/633 |
| 5,436,650 | 7/1995 | Kobayashi et al. | 347/63 |
| 5,479,197 | 12/1995 | Fujikawa et al. | 347/63 |
| 5,491,505 | 2/1996 | Suzuki et al. | 347/203 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Joseph Hartary
*Attorney, Agent, or Firm*—Fitzpatrick, Cella, Harper & Scinto

[57] ABSTRACT

A process for producing an ink jet head having ink discharging outlets, a substrate with energy generating elements that discharge ink, ink pathways aligned with the energy generating elements and communicated with the ink discharging outlets, and a liquid chamber for storing and supplying ink into the ink pathways. The process involves providing first and second substrates, forming on the first substrate a first solid layer having a pattern for forming ink pathways while using a surface of the first substrate as bottom walls for the ink pathways, forming on the first solid layer a second solid layer with a pattern for the liquid chamber, laminating the second substrate on the first substrate such that the opening of the second substrate is sealed by the second solid layer, to obtain a stacked body with space for forming circumferential walls for the ink pathways and liquid chamber, filling the space with hardening material, hardening the hardening material, and dissolving the first and second solid layers of the stacked body to remove the first and second solid layers, thereby forming the liquid chamber and ink supplying pathways.

19 Claims, 8 Drawing Sheets

PROCESS FOR THE PRODUCTION OF AN INK JET HEAD

BACKGROUND OF THE INVENTION

1. Field of The Invention

The present invention relates to an improved process for efficiently producing a high quality ink jet head for discharging ink as a printing droplet by way of an ink jet system, to perform printing for a printing medium.

2. Related Background Art

There are known a number of ink jet heads used in an ink jet system for performing printing. These ink jet heads are usually provided with a discharging outlet of discharging ink (that is, an ink discharging outlet), a liquid chamber containing ink to be supplied to the discharging outlet, a liquid pathway which communicates the discharging outlet with the liquid chamber, an energy generating element which is disposed at a given portion of the liquid pathway and which generates energy utilized for discharging ink from the discharging outlet, and an ink supply port for externally supplying ink into the liquid chamber.

As for the production of such ink jet head, there is known a process wherein a first substrate for an ink jet head which is provided with energy generating elements and a second substrate made of a glass or metal which is provided with a recess for forming discharging outlets, liquid pathways and a liquid chamber and which is also provided with a port (which serves to supply ink therethrough) to be communicated with a liquid chamber to be formed are provided, the second substrate is laminated to the first substrate with the use of an adhesive while positioning them to establish a liquid chamber and a plurality of liquid pathways each having a discharge outlet wherein each of the liquid pathways contains one of the energy generating elements positioned therein, whereby obtaining a ink jet head. Other than this, there is also known a process wherein a first substrate for an ink jet head which is provided with energy generating elements and a second substrate made of a glass or metal which is provided with a port (which serves to supply ink therethrough) to be communicated with a liquid chamber to be formed are provided, a dry film made of a photosensitive resin is laminated on the energy generating elements-bearing surface of the first substrate, the dry film laminated on the surface of the first substrate is subjected patterning to form a recess for forming a plurality of liquid pathways each containing one of the energy generating element and a liquid chamber, and the second substrate is laminated on the treated surface of the first substrate with the use of an adhesive to establish a liquid chamber and a plurality of liquid pathways each having a discharge outlet wherein each of the liquid pathways contains one of the energy generating elements positioned therein, whereby obtaining a ink jet head.

However,. any of these processes have such problems as will be described in the following. That is, in any of these processes, as above described, the second substrate is laminated to the first substrate with the use of an adhesive, in this lamination step, the adhesive has a tendency of flowing into the liquid pathway-forming recesses to make the resulting liquid pathways to be uneven in terms of their shapes. This situation is liable to make an ink jet head obtained such that provides a variation for a state of ink discharged from each discharging outlet, in the worst case.

In order to eliminate the problems in the above described processes, U.S. Pat. No. 4,775,445 (hereinafter referred to as document 1) describes a process for producing an ink jet recording head wherein its liquid pathways are formed without using an adhesive. The process described in document 1 is of the following contents. That is, a substrate for an ink jet recording head which is made of silicon or glass and provided with energy generating elements is provided, and on the energy generating elements-bearing surface of the substrate, there is formed a solid layer having a portion serving to form discharging outlets, liquid pathways and a liquid chamber by laminating a positive or negative type photosensitive dry film on the energy generating elements-bearing surface of the substrate, followed by subjecting the photosensitive dry film on the substrate to patterning by way of photolithography. Thereafter, a liquid hardening material is applied onto the substrate having the solid layer thereon at a desired thickness, followed by hardening the liquid hardening material disposed on the first substrate, to thereby obtain a stacked body. The stacked body thus obtained is immersed in a solvent capable of dissolving the solid layer to remove the solid layer, whereby establishing a plurality of liquid pathways each containing one of the energy generating elements and having a discharging outlet and a liquid chamber. By this, there is obtained an ink jet head (that is, an ink jet recording head).

The process described in document 1 has an advantage in that since the liquid pathways are formed by the substrate and the hardening material wherein the lamination of the substrate with the hardening material is conducted by virtue of an adhesion caused upon hardening the hardening material, there can be obtained a ink jet head without using an adhesive.

However, as for the process described in document 1, there are problems such that the capacity of the liquid chamber is governed by the area of the solid layer resulted by way of the patterning, it is therefore difficult to attain an increased capacity for the liquid chamber so as to be suitable in the case where a great many of liquid pathways are arranged at a high arrangement density, and this situation makes it difficult to obtain an ink jet head having a great many discharging outlets arranged at a high arrangement density which can perform printing at a high speed while smoothly and effectively supplying ink to the liquid pathways.

In view of these problems for the process described in document 1, U.S. Pat. No. 5,030,317 (hereinafter referred to as document 2) describes a process for producing an ink jet head having a liquid chamber with an increased capacity. The process described in document 2 is of the following contents. That is, a first substrate for an ink jet recording head which is made of silicon or glass and provided with energy generating elements is provided, and on the energy generating elements-bearing surface of the first substrate, there is formed a solid layer having a portion serving to form discharging outlets, liquid pathways and a liquid chamber by laminating a positive or negative type photosensitive dry film on the energy generating elements-bearing surface of the first substrate, followed by subjecting the photosensitive dry film on the first substrate to patterning by way of photolithography. Thereafter, a liquid of a material capable of being hardened with the irradiation of active energy rays (this material will be hereinafter referred to as hardening material) is applied onto the substrate having the solid layer thereon to form a liquid layer having a desired thickness. Then on the liquid layer of the liquid hardening material of the first substrate, a second substrate which is made of a material having a property of allowing active energy rays to transmit therethrough and which is provided with an ink supply port is press-contacted to obtain a stacked body. The hardening material layer of the stacked body is subjected to patterning by irradiating active energy rays through the second substrate, wherein the hardening material layer except for a portion of thereof serving to form a liquid chamber is insolubilized to form a latent pattern for the formation of the liquid chamber. The stacked body thus treated is immersed in a solvent capable of dissolving the solid layer and the non-insolubilized hardening material to remove the solid layer and the non-insolubllized hardening material, whereby establishing a plurality of liquid pathways each containing one of the energy generating elements and having a discharging outlet and a liquid chamber. By this, there is obtained an ink jet head (that is, an ink jet recording head).

The process described in document 2 has an advantage in that since the liquid chamber is formed by the foregoing non-insolubilized portion of the hardening material and the solid layer, the liquid chamber can be made to have a relatively large capacity, and because of this, there can be obtained a ink jet head in which ink can be smoothly and effectively supplied ink to the liquid pathways at the time of performing printing at a high speed.

However, the process described in document 2 has drawbacks such that there is a limit for the thickness of the hardening material layer because when the hardening material layer is made to be excessively thickened, the latent pattern for the formation of the liquid chamber cannot be conducted at a desired precision and because of this, it is difficult to attain an increased capacity for the liquid chamber so as to be suitable in the case where a great many of liquid pathways are arranged at a high arrangement density, and this situation makes it difficult to obtain an ink jet head having a great many discharging outlets arranged at a high arrangement density which can perform printing at a high speed while smoothly and effectively supplying ink to the liquid pathways.

Document 2 however describes a manner of making the liquid chamber to have a large capacity by forming a recess capable becoming a part of a liquid chamber at the second substrate and forming the liquid chamber by said recess, the solid layer and the non-insolubilized portion of the hardening material layer.

In any case, there is a problem for the process described in document 2 in that the height of a liquid chamber formed is governed by the thickness of the hardening material layer and also the magnitude of the pressure applied upon the press-contact of the second substrate to the hardening material layer of the first substrate, and because of this, it is difficult to attain a desirable uniformity for the height for a liquid chamber formed in every production lot of an ink jet head. In addition, there is a further problem in that the lamination of the second substrate to the first substrate through the hardening material layer is conducted by way of press-contact as above described, and because of this, the first and second substrates are sometimes laminated in such a state that they are not parallel to each other, wherein the resulting liquid chamber becomes not to have an even height but to have such a height that is positionaly varied, and this situation makes the resulting ink jet head such that the amount of ink supplied into each liquid pathway is varied to provide a variation for the amount discharged from each discharging outlet, resulting in making prints obtained to be varied in terms of quality. In the process described in document 2, in order to attain a uniformity for the height of the liquid chamber, it is necessary to use an independent assembling apparatus (not described in document 2) capable of precisely positioning the first and second substrate upon the lamination of them through the hardening material layer. However, if such assembling apparatus should be used, in the case where the second substrate has an inherent warp, a liquid chamber formed unavoidably becomes to have such a height that is positionaly varied, resulting in entailing such problems as above described.

The above described problems as for the process of document 2 would be not remarkable in the case of producing an ink jet head in which the number of liquid pathways is small but they cannot be disregarded in the case of producing a prolonged ink jet head having a longer discharging outlet than the width of a printing medium which is represented by a so-called full-line type ink jet head.

In order to eliminate such problems found in the process of document 2, U.S. Pat. No. 5,3332,466 (hereinafter referred to as document 3) proposes a process for producing an ink jet head (an ink jet recording head) wherein one or more spacer members are provided at a first substrate (that is, a substrate for an ink jet head) or a second substrate (that is, a top plate) so that the first and second substrates can be laminated in parallel to each other through a hardening material layer. Particularly, the process of document 3 is similar to the process of document 2, except for using the spacer member in the former. It is understood that according to the process of document 3, the first and second substrates can be laminated in parallel to each other through the hardening material layer by the action of the spacer member without using the foregoing assembling apparatus, and because of this, there can be attained the production of an ink jet head having a liquid chamber with a uniform height. Further, it is understood that in the process of document 3, even in the case where the second substrate should be accompanied with a warp, the second substrate is press-contacted to the first substrate while utilizing the action of the spacer member wherein the second substrate is straightened and the thickness of the hardening material layer is not varied.

However, in the process of document 3, each spacer nember is disposed at an end portion of either the first or second substrate where no solid layer is present in order to prevent the solid layer from suffering from a pressure, and because of this, in the case where the central portion of the second substrate is warped toward to the first substrate, it is impossible to straighten the second substrate, wherein a liquid chamber with a varied height is unavoidably formed. In this case, if the warped second substrate is press-contacted through the hardening material layer to the first substrate while straightening the warped second substrate, a stress is remained between the straightened second substrate and the hardening material layer, wherein there is a tendency of causing a removal at the interface between the second substrate and the hardening material layer due to a change in the environmental temperature during the production process.

Further, in any of the processes described in documents 2 and 3, there are problems such that in order to make the hardening material to be uniformly contacted with the second substrate, the hardening material in a relatively large amount is necessary to be applied, wherein a problem is liable to entail in that the hardening material is extruded outside upon the lamination of the first and second substrates through the hardening material, wherein such hardening material extruded scatters to deposit on the exposure apparatus and those hardening materials deposited on the exposure apparatus are eventually hardened to entail a problem of reducing the working efficiency. In addition, in any of the processes of documents 2 and 3, because the hardening material is required to be patterned with the irradiation of active energy rays as above described, only photo-setting resins can be used as the hardening material. Further, the second substrate is required to be constituted by a specific material having a property of allowing active energy rays to transmit therethrough.

SUMMARY OF THE INVENTION

A principal object of the present invention is to eliminated the foregoing problems found in the prior art and to provide an improved process which enables to effectively and efficiently produce a high quality ink jet head without the foregoing problems found in the prior art.

Another object of the present invention is to provide an improved process for effectively and efficiently producing a desired ink jet head while attaining a desired capacity and a uniform height for a liquid chamber formed.

A further object of the present invention is to provide an improved process for effectively and efficiently producing a desired ink jet head while disposing a desirable hardening material thoroughly between a first substrate (that is, a substrate for an ink jet head) and a second substrate (that is, a top plate) with the use of the hardening material in a reasonable amount.

A further object of the present invention is to provide an improved process for effectively and efficiently producing a desired ink jet head with the use of a thermosetting resin as the hardening material and while forming liquid pathways without using an adhesive.

A further object of the present invention is to provide an improved process for effectively and efficiently producing a desired ink jet head while forming liquid pathways without using an adhesive and without the necessity of using a specific material having a property of allowing active energy rays to transmit therethrough as the second substrate as in the prior art.

DESCRIPTION OF THE INVENTION AND PREFERRED EMBODIMENTS

Figure 1:
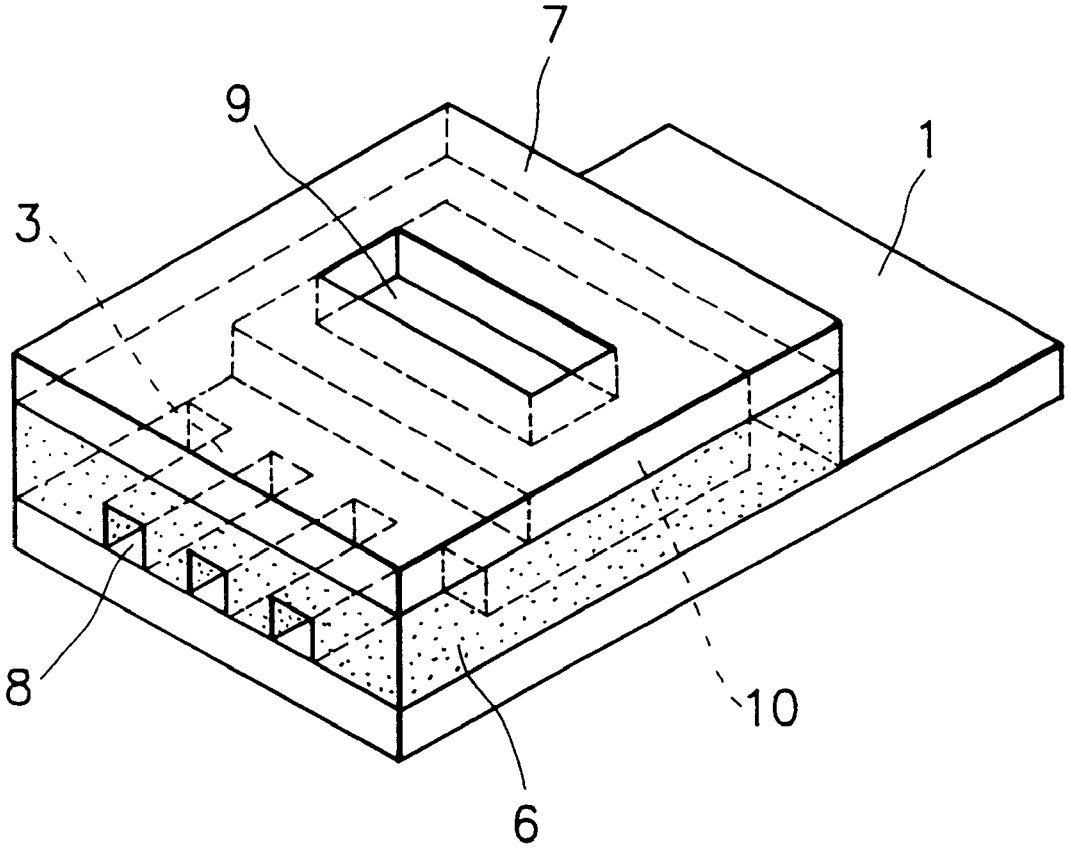
FIG. 1 is a schematic perspective view illustrating an example of an ink jet head produced according to the present invention.

The present invention attains the above objects. That is, the present invention is to provide an improved process which enables to effectively and efficiently produce a high quality ink jet head without the foregoing problems found in the prior art.

A typical embodiment of the present invention is directed to a process for producing an ink jet head including (a) a plurality of ink discharging outlets, (b) a substrate for an ink jet head including a plurality of energy generating elements for generating energy utilized for discharging ink from said ink discharging outlets, (c) a plurality of ink pathways aligned with said energy generating elements and communicated with said ink discharging outlets, and (d) a liquid chamber for storing and supplying said ink into said ink pathways, said process comprising the steps of:

(i) providing a first substrate as said substrate (b) which is provided with said energy generating elements; and a second substrate having an opening serving to supplying said ink to said liquid chamber (d);

(ii) forming on said first substrate a first solid layer having a pattern for forming said ink pathways (c) while utilizing a surface of said first substrate as bottom walls for said ink pathways;

(iii) forming on said first solid layer a second solid layer having a pattern for forming said liquid chamber (d);

(iv) laminating said second substrate on said first substrate having said first and second solid layers thereon such that said opening of said second substrate is sealed by said second solid layer, to thereby obtain a stacked body having a space for forming circumferential walls for said ink pathways (c) and said liquid chamber (d);

(v) filing said space with a hardening material;

(vi) hardening said hardening material; and (vii) dissolving said first and second solid layers of said stacked body to remove the first and second solid layers, whereby forming said liquid chamber (d) and said ink supplying pathways (c) of providing said ink discharging outlets (a).

Another embodiment of the present invention is directed to an ink jet head produced in accordance with the above process.

A principal feature of the process according to the present invention is that a two-layered structure comprising the foregoing first and second solid layers stacked in the named order is disposed on the first substrate (which means a substrate for an ink jet head in other words), the second substrate (which means a so-called top plate having a ink supply port) is laminated onto the two-layered structure such that the opening of the second substrate is sealed by the second solid layer of the two-layered structure to thereby obtain the foregoing stacked body having a space for forming circumferential walls for the liquid pathways (the ink pathways) and liquid chamber, the space is filled with an appropriate hardening material, the hardening material thus filled is hardened, and the two-layered structure is removed using an appropriate solvent, whereby a liquid chamber and ink pathways each providing an ink discharging outlet and a liquid chamber are formed to obtain an ink jet head.

This constitution of the present invention provides pronounced advantages as will be described in the following.

That is, the hardening material in a reasonable amount can be effectively supplied so as to thoroughly fill the space intentionally provided between the first and second substrates without invading into the opening of the second substrate and without bulging out, and therefore, the application of the hardening material can be markedly efficiently practiced without causing a loss of the hardening material and without the foregoing problems upon the application of the hardening material found in the prior art.

And it is not necessary for the hardening material applied to be patterned as in the prior art, and because of this, the process for the production of an ink jet head can be markedly simplified, and an appropriate thermosetting resin can be used as the hardening material. In the case where a thermosetting resin is used as the hardening material, it is not necessary for the second substrate to be constituted by a specific material capable of allowing active energy rays to transmit therethrough but the second substrate can be constituted by an appropriate material incapable of allowing active energy rays to transmit therethrough.

Further, in the process according to the present invention, it is not necessary to use such spacer member as used in the prior art, and because of this, the solid layer formed can be made to have an increased area.

Furthermore, a precise and tight contact of the solid layer with the opening of the second substrate in an optimum state can be always easily attained, and the lamination of the first substrate with the second substrate can be effectively and efficiently conducted at a higher precision than that in the prior art.

In addition, in the process according to the present invention, the liquid chamber is established by the two patterned solid layers (that is, the first and second solid layers) and therefore, the liquid chamber can be effectively made to have a sufficient capacity as desired. Further in addition, the shape of the liquid chamber is governed only by the two patterned solid layers, and therefore, even if the second substrate should be in a warped state, the liquid chamber can be effectively made to have a uniform height.

Further in addition, in the process according to the present invention, there can be effectively and efficiently produced a high quality ink jet having a liquid chamber having a sufficient capacity and a uniform height as long as the opening (serving as an ink supply port) of the second substrate is sealed by the patterned second solid layer, and therefore, a severe precision is not required upon the assembly of the first and second substrates.

The present invention has been accomplished based on the following findings obtained through experiments which were carried out by the present inventors in order to eliminate the foregoing problems found in the prior art and in order to attain the foregoing objects.

As previously described, in the prior art (particularly, in the process of document 3), the lamination of the second substrate to the first substrate through the hardening material is conducted by press-contacting the hardening material on the first substrate while using the spacer member in order to make the hardening material to thoroughly contact with the second substrate and also in order to straighten the second substrate when it is warped, wherein not only in order to prevent the solid layer from suffering from a pressure, the spacer member is disposed at an end portion of either the first or second substrate where no solid layer is present.

The process of this constitution in the prior has such problems as previously described. That is, in the case where the central portion of the second substrate is warped toward to the first substrate, it is impossible to straighten the second substrate, wherein a liquid chamber with a varied height is unavoidably formed. In this case, if the warped second substrate is press-contacted through the hardening material layer to the first substrate while straightening the warped second substrate, a stress is remained between the straightened second substrate and the hardening material layer, wherein there is a tendency of causing a removal at the interface between the second substrate and the hardening material layer due to a change in the environmental temperature during the production process.

In order to eliminate these problems in the prior art, the present inventors conceived an idea that since the height of a liquid chamber is governed by the solid layer, it would be possible to produce a desirable ink jet head having a liquid chamber having a uniform height even when the second substrate is warped, by utilizing the solid layer as a spacer. However, as a result of experimental studies, it was found that this idea is not effective because when the solid layer as the spacer is pressed at a relatively strong pressure, the solid layer is liable to deform. Based on this finding, the present inventors made experimental studies in order to find out a manner which enables to produce a desirable ink jet head having a liquid chamber having a uniform height while utilizing the solid layer as the spacer but without effecting a strong pressure to the solid layer. As a result, there was obtained a finding that when the solid layer is designed to have a two-layered structure comprising a first solid layer and a second solid layer stacked in the named order from the second substrate side (this two-layered structure will be hereinafter referred to as two-layered solid layer), the two-layered structure is disposed on a first substrate (that is, a substrate for an ink jet head), a second substrate having an opening (serving as an ink supply port) (that is, a top plate in other words) is contacted to the second solid layer such that the opening of the second substrate is tightly sealed by the second solid layer to obtain a stacked body having a space serving to form circumferential walls of liquid pathways (or ink pathways) and a liquid chamber, and the space is filled by a hardening material, the above object can be effectively attained.

It was found that this constitution provides pronounced various advantages as will be described in the following. That is, (1) it is sufficient to press the second substrate at a pressure such that at least the opening of the second substrate can be sealed by the second solid layer and because of this, the second solid layer is not deformed and the hardening material is thoroughly contacted with the second substrate; (2) even in the case where the second substrate should be somewhat warped, since the height of a liquid chamber formed is governed by the two-layered solid layer, there can be produced an ink jet head having a liquid chamber with a uniform height; (3) even in the case where the second substrate should be greatly warped, the shape of a liquid chamber formed is substantially governed by the two-layered solid layer, there can be produced an ink jet head having a liquid chamber with a substantially uniform height without straightening the warped second substrate; (4) since the warped second substrate is not necessary to be straightened, a removal is hardly occurred at the interface between the second substrate and the hardening material layer due to a change in the environmental temperature during the production process; (5) the hardening material in a reasonable amount can be effectively supplied so as to thoroughly fill the space intentionally provided between the first and second substrates without invading into the opening of the second substrate and without bulging out, and it is not necessary for the hardening material thus supplied to be subjected to patterning; (6) since the hardening material supplied is not necessary to be patterned, it is possible to use a thermosetting resin as the hardening material; and (7) in the case of using such thermosetting resin as the hardening material, it is possible to constitute the second substrate by an appropriate material incapable of allowing active energy rays to transmit therethrough.

The present invention has been accomplished based on these findings.

In the following, the present invention will be described with reference to FIGS. 1 to 6.

FIG. 1 is a schematic perspective view illustrating an example of an ink jet head produced according to the present invention.

Figure 2:
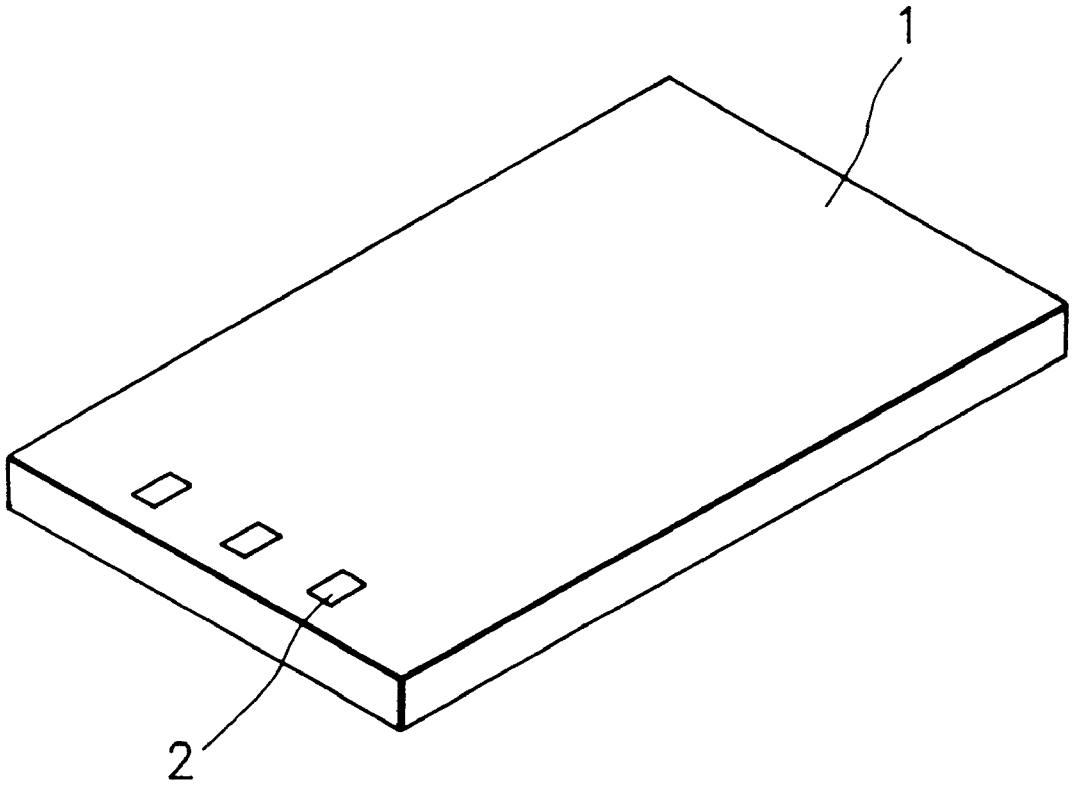
FIG. 2 is a schematic view illustrating an example of an energy generating element-bearing substrate for an ink jet head which is used in the production of an ink jet head in the present invention.
Figure 3:
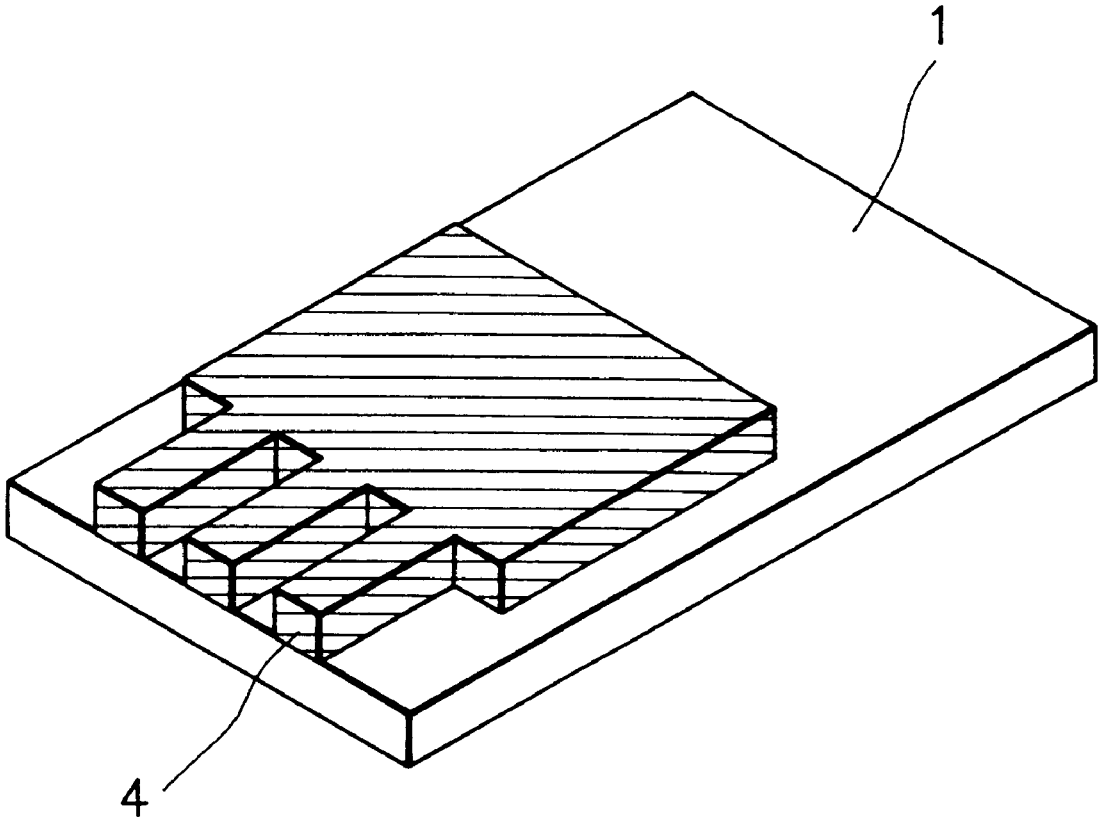
FIG. 3 is a schematic view for explaining a step of forming a patterned first solid layer serving to form liquid pathways and a liquid chamber and capable of being removed on the substrate shown in FIG. 2 during the production of an ink jet head in the present invention.
Figure 4:
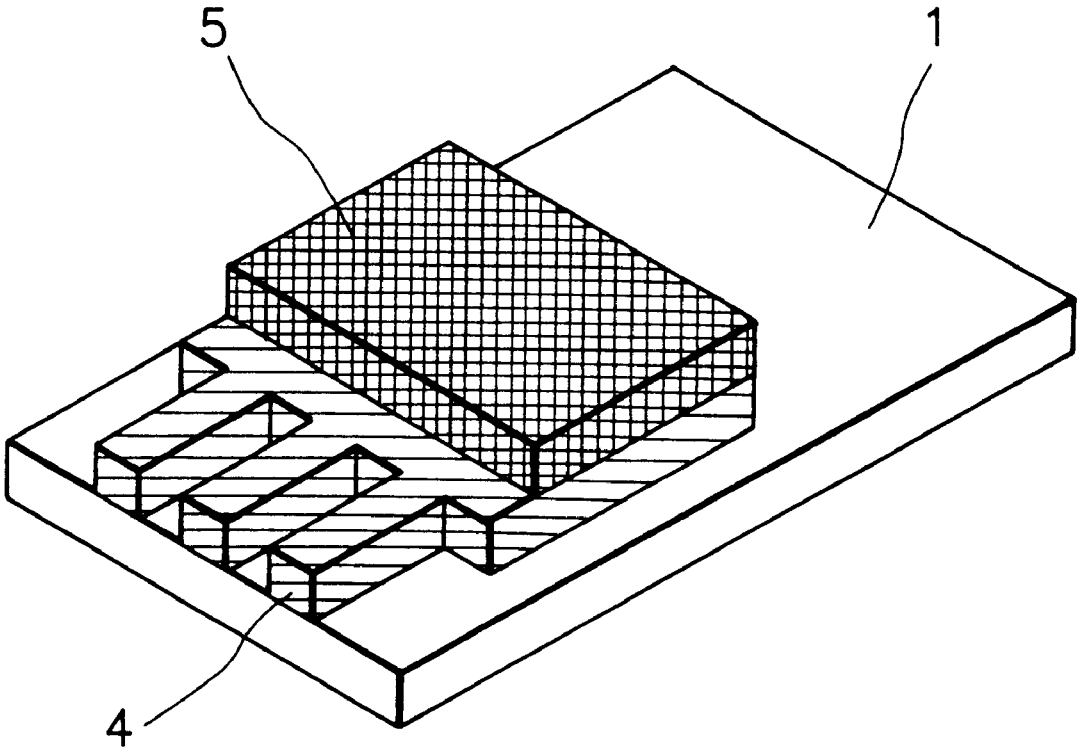
FIG.4 is a schematic view for explaining a step of forming a patterned second solid layer serving to form a liquid chamber and capable of being removed on the first solid layer shown in FIG. 3 during the production of an ink jet head in the present invention.
Figure 5:
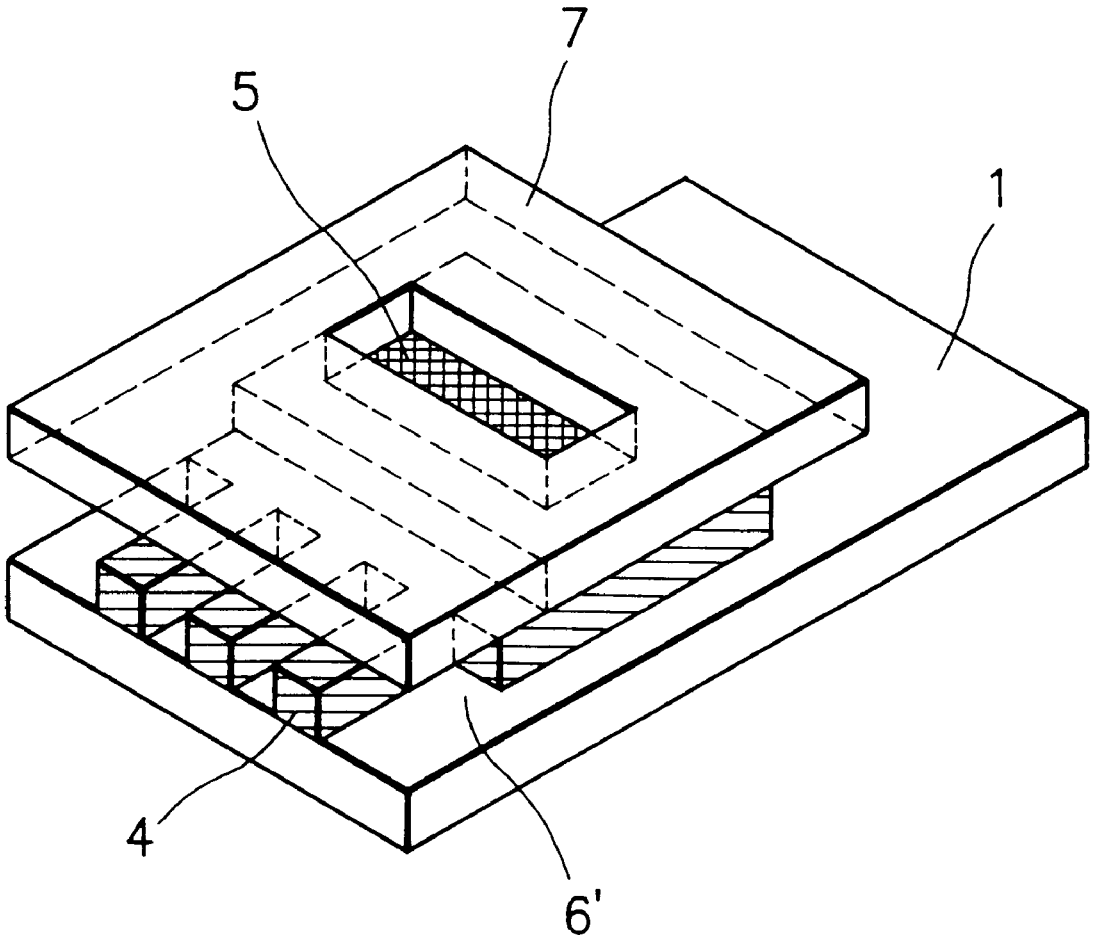
FIG. 5 is a schematic view for explaining a step of laminating a second substrate having an ink supply port to to the second solid layer formed in the step shown in FIG. 4 to obtain a stacked body having a space serving to form circumferential walls of liquid pathways and a liquid chamber during the production of an ink jet head in the present invention.
Figure 6:
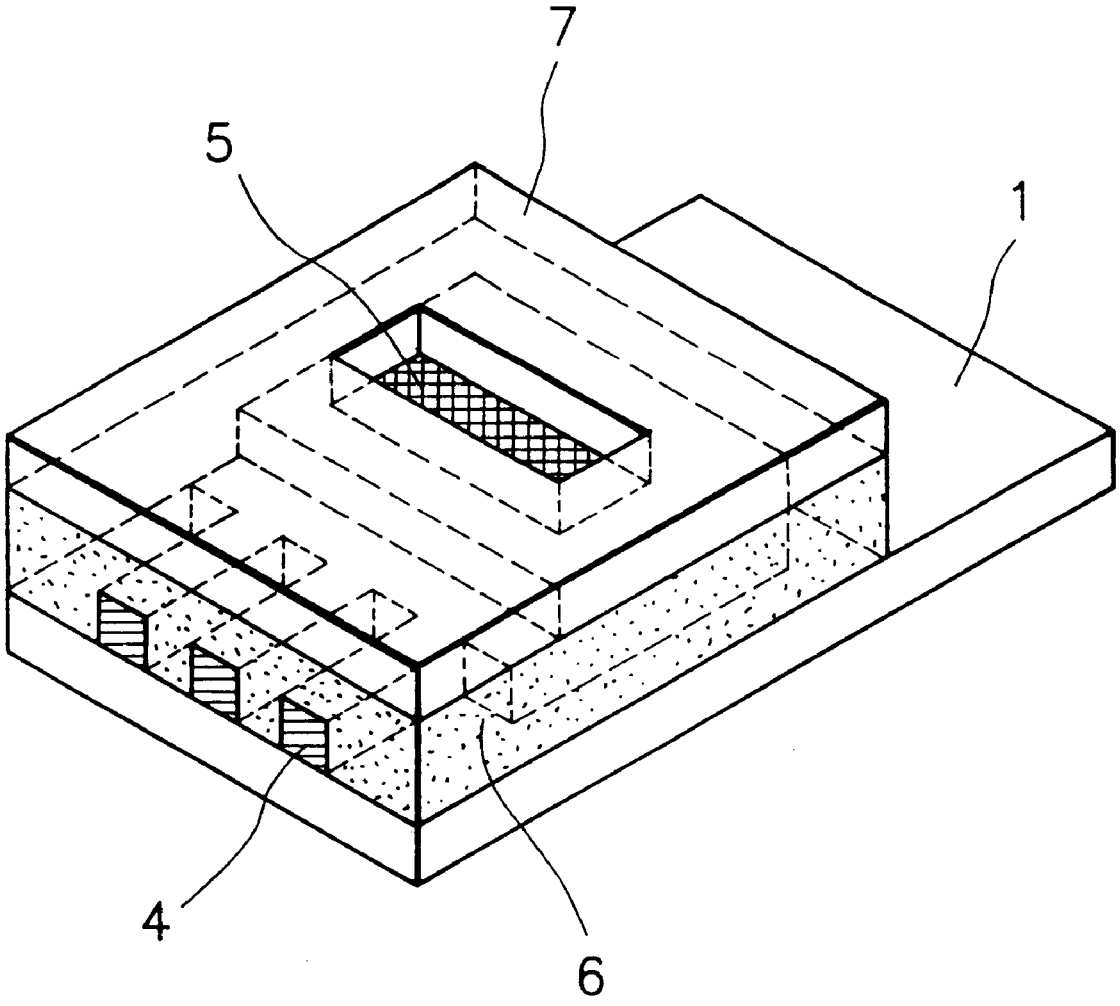
FIG. 6 is a schematic view for explaining a step of filling the space of the stacked body obtained in the step shown in FIG. 5 with a hardening material capable of serving to form circumferential walls and a liquid chamber during the production of an ink jet head in the present invention.

FIGS. 2 to 6 are schematic views for explaining the production steps to produce an ink jet head having the constitution shown in FIG. 1. Particularly, FIG. 2 is a schematic view illustrating an example of an energy generating element-bearing substrate for an ink jet head which is used in the production of an ink jet head in the present invention. FIG. 3 is a schematic view for explaining a step of forming a patterned first solid layer serving.to form liquid pathways and a liquid chamber and capable of being removed on the substrate shown in FIG. 2 during the production of an ink jet head in the present invention. FIG. 4 is a schematic view for explaining a step of forming a patterned second solid layer serving to form a liquid chamber and capable of being removed on the first solid layer shown in FIG. 3 during the production of an ink jet head in the present invention. FIG. 5 is a schematic view for explaining a step of laminating a second substrate having an ink supply port to to the second solid layer formed in the step shown in FIG. 4 to obtain a stacked body having a space serving to form circumferential walls of liquid pathways and a liquid chamber during the production of an ink jet head in the present invention. FIG. 6 is a schematic view for explaining a step of filling the space of the stacked body obtained in the step shown in FIG. 5 with a hardening material capable of serving to form circumferential walls and a liquid chamber during the production of an ink jet head in the present invention.

In the description in FIGS. 1 to 6, only three discharging outlets are described, but this is only for the simplification purpose. In practice, a number of discharging outlets are usually arranged at a high arrangement density in an ink jet head according to the present invention.

In the process according to the present invention, as the first substrate, there is used a substrate 1 (for an ink jet head) shown in FIG. 2 which is provided with a plurality of energy generating elements 2 spacedly arranged thereon.

The substrate 1 may be constituted by an appropriate material selected from the group consisting of silicon, glass, ceramics, plastics, metals, and metal alloys.

The substrate 1 also serves not only as a liquid pathway wall-forming member but also as a liquid chamber wall-forming member. Other than this, the substrate 1 further serves as a support for a hardening material layer which will be later explained. There is no particular limitation for the shape of the substrate 1. The substrate 1 can be obtained in a manner of cutting a wafer into a plurality of wafer members having a predetermined size.

As above described, on the substrate 1, a plurality of energy generating elements 2 are spacedly arranged at an equal interval. The energy generating element 2 may comprise an electrothermal converting element or piezo-electric element. In FIG. 2, there are shown only three energy generating elements, but this is only for the simplification purpose. In practice, a number of energy generating elements are usually arranged on the substrate 1. Each energy generating element serves to effect energy to ink in a liquid pathway (or an ink pathway) resulting in discharging ink in a liquid droplet from a discharging outlet, whereby providing a print on a printing medium as as a paper. Particularly, in the case where an electrothermal converting element is used as the energy generating element, the electrothermal converting element generates thermal energy to heat ink present in the vicinity thereof whereby causing a state change for the ink to form a bubble, wherein energy generated based on a pressure change caused upon the formation of the bubble effects as discharging energy to result in discharging ink in a droplet from a discharging outlet. In the case where a piezo-electric element is used as the energy generating element, energy cased by the mechanical vibration of the piezo-electric element effects as discharging energy to discharge ink in a droplet from a discharging outlet.

In any case, the energy generating element 2 includes a control signal inputting electrode electrically connected thereto (not shown). The substrate 1 may contain an appropriate functional layer such as a protective layer capable of improving the durability of the energy generating element 2 which is disposed thereon.

In the step shown in FIG. 3, on the substrate 1 shown in FIG. 2 having a plurality of energy generating elements thereon, a first solid layer 4 comprising a patterned layer comprised of a material capable of being removed at later stage is formed. As apparent from FIG. 3, the first solid layer 4 has a pattern for forming liquid pathways (or ink pathways) and a liquid chamber. As for the material by which the first solid layer 4, any materials may be used as long as they can be easily removed at later stage. Preferred examples of such material are resists which can be easily removed at later at later stage and can be easily patterned by way of photolithography at a desired precision. Of these resists, positive type photoresists are the most desirable since they are superior to negative type photoresists in terms of resolution and they enable to easily form a relief pattern having a vertical and flat side wall face or having a cross-section form in a taper or reverse taper shape.

Specific examples of such positive type photoresist are naphthoquinone series positive type photoresists, positive type photoresists of chemical amplification type, and positive type photoresists of backbone chain decomposition type.

The first solid layer 4 may be formed by a manner of providing a dry film composed of a given positive type photoresist and laminating the dry film on the surface of the substrate 1 or a manner of providing a coating liquid of a given positive type photoresist and applying the coating liquid on the surface of the substrate 1 by means of roll coating or spin coating, followed by drying.

In the step shown in FIG. 4, on the first solid layer 4 formed in the step shown in FIG. 3, a second solid layer 5 comprising a patterned layer composed of a material capable of being easily removed at later stage. The second solid layer 5 serves to form a liquid chamber. As for the material by which the second solid layer 4, any materials may be used as long as they can be easily removed at later stage. However, it is desired to use a material which can be easily removed together with the material constituting the fist solid layer 4 by way of dissolution with the use of a solvent. In a preferred embodiment, it is comprised of a material which has a property similar to that of the positive type photoresist constituting the first solid layer 4.

The formation of the second solid layer 5 is desired to be conducted by a manner which enables to form it without damaging the first solid layer 4 and without conducting development with the use of a solvent. Preferable examples of such manner are printing processes such as screen printing and pattern transfer printing.

Of these printing processes, screen printing process is the most desirable because it can easily attain a desired pattern precision and a desired surface smoothness for a solid later formed as the second solid layer 5.

As the material used for the formation of the second solid layer 5 by means of the printing process, it is desired to use a resin which excels in removal in mold and does not cause bleeding of printing. As such resin, there can be mentioned plating resists and solder resists.

The formation of the second solid layer 5 by the printing process using a given solder resist may be conducted, for example, by a manner of providing a coating liquid composed of the solder resist and a solvent, applying the coating liquid on the surface of the first solid layer 4 at a desired thickness to form a layered coat on the surface of the first solid layer, and subjecting the layered coat to drying at normal temperature for about an hour to remove the solvent contained the layered coat and solidify the layered coat, whereby forming a layer having a desired thickness as the second solid layer. In this case, since the amount of the solvent contained in the layered coat is very small, by subjecting the layered coat to drying soon after the formation thereof, the pattern of the first solid layer is prevented from deforming.

In the step shown in FIG. 5, a plate 7 (that is, a top plate) as the second substrate is laminated to the second solid layer 5 formed in the step shown in FIG. 4 as shown in FIG. 5.

The top plate 7 is provided with an opening serving as an ink supply port. The top plate 7 is laminated to the second solid layer 5 such that the opening thereof is tightly sealed by the second solid layer 5 to form a stacked body having a space 6' serving to form circumferential walls of liquid pathways and a liquid chamber which is filled by a hardening resin as will be later described, wherein the first substrate 1 and the second substrate 7 (or the top plate) are arranged to be in parallel to each other at an equal interval as for each side because of the presence of the first solid layer 4 and the second solid layer 5 between them.

As for the second substrate 7, as an ink supply member (not shown) for receiving ink from a ink container (not shown) is connected to the ink supply port of the second substrate, it is required to be constituted by a material capable of allowing the ink supply member to surely fix to the second substrate. Specific examples of such material are silicon materials, glass, ceramics, metals and metal alloys.

In the case where a photo-setting material is used as the above described hardening material, the second substrate 7 is required to be constituted by a material capable of allowing active energy rays to transmit therethrough.

Other than the opening, the second substrate 7 may be provided with a recess (not shown) serving to increase the capacity of a liquid chamber to be formed on its surface to be contacted with the second solid layer 5. The recess is usually designed to communicate with the opening. The recess is required to be of a size which is smaller than that of the second solid layer 5. In this case, the second substrate 7 is laminated to the second solid layer 5 such that the recess is tightly sealed by the second solid layer, wherein the opening is eventually sealed.

In the step shown in FIG. 6, as above described, the space 6' of the stacked body obtained in the step shown in FIG. 5 is filled using a proper hardening material 6 in the liquid state as shown in FIG. 6.

In the process of the present invention, as above described, the second substrate 7 is laminated to the second solid layer 5 such that the opening of the second substrate is tightly sealed by the second solid layer, and the hardening material 6 in a reasonable amount can be effectively supplied into the space 6' (see, FIG. 5) between the first and second substrate so as to thoroughly fill the space without invading into the opening of the second substrate and without bulging out. This situation enables to effectively and efficiently for desirable liquid pathways and a liquid chamber only by removing the first solid layer 4 and the second solid layer 5.

The introduction of the hardening material 6 into the space 6' (see, FIG. 5) may be conducted under reduced pressure. In this case, the filling efficiency of the hardening material to the space between the first and second substrates is facilitated such that the entire of the space is effectively filled by the hardening material.

The hardening material 6 can include thermosetting resins, photo-setting resins, and other resins capable of being hardened by light and heat in combination. In any case, of these resins, it is desired to selectively use an appropriate hardening resin which excels in adhesion with any of the first and second substrates, mechanical strength, and corrosion resistance (that is, resistance to ink). Specific examples of such photo-setting resin are photo-setting resin compositions based on bisphenol A type epoxy resins, bisphenol F type epoxy resins, or novolak type epoxy resins and containing an onium salt capable of generating a cation when subjected to light irradiation. Specific examples of such thermosetting resin are thermosetting resin compositions based on bisphenol A type epoxy resins, bisphenol F type epoxy resins, or novolak type epoxy resins and containing an amine series hardener.

The hardening material 6 introduced into the space between the first and second substrate is hardened, and thereafter, the first solid layer 4 and the second solid layer 5 are removed by dissolving them with a solvent, whereby liquid pathways each containing an energy generating element 2 and having a discharging outlet and a liquid chamber are established to obtain an ink jet head of the constitution shown in FIG. 1. In FIG. 1, numeral reference 1 indicates a substrate for an ink jet head (that is, the first substrate), numeral reference 3 a liquid pathway (or ink pathway), reference numeral 6 the hardened hardening material, reference numeral 7 a top plate (that is, the second substrate), reference numeral 8 a discharging outlet, reference numeral 9 the opening of the second substrate (serving as an ink supply port), and reference numeral 10 a liquid chamber.

The solvent used for removing the first and second solid layers can include an aqueous solution of sodium hydroxide, and organic solvents such as acetone. In the case where it is difficult to entirely remove the first and second solid layer only by means of the solvent, it is possible to conduct ultrasonic cleaning or bubbling treatment.

By the way, it is known that the ink discharging characteristics of an ink jet head depend on the liquid pathway length. In the present invention, it is possible to properly adjust the liquid pathway length to a desired length. In this case, it is possible to employ a conventional wafer cutting process such as dicing process.

Further, in the present invention, it is possible to cut a ink discharging outlet face of the product obtained in the step shown in FIG. 6 prior to removing the first and second solid layers. In this case, there is no occasion for foreign matters to be contaminated into the liquid chamber and liquid pathways because neither liquid chamber nor liquid pathways are established at this state because the first and second solid layers are not yet removed.

The process of the present invention for producing an ink jet head has various pronounced advantages as will be described in the following.

(i) The principal step is based on the photolithography technique using a photoresist or dry film, and because of this, the fine portions of an ink jet head can be extremely easily formed in desired patterns. And other than this, it is possible to effectively produce a plurality of ink jet heads having the same constitution at the same time.

(ii) It is possible to easily form a liquid chamber having a large capacity by the manner of stacking the two solid layers having an identical property by way of the screen printing process, wherein the two solid layers can be easily removed. This enables to produce a desirable ink jet head having a prolonged ink discharging outlet face provided with a great many of discharging outlets arranged at a high arrangement density which always exhibits a stable ink discharging performance even upon performing printing at a high speed over a long period of time, wherein stable ink supply to the liquid pathways is continuously conducted.

(iii) As the second solid layer functions as a spacer for the first and second substrates, the first and second substrates are arranged in parallel to each other while maintaining an equal interval at each side and because of this, there can be formed a layer composed of the hardening resin at a uniform thickness in the space between the first and second substrate. By this, there can be effectively and efficiently produced a desirable ink jet head which is free of a removal between the two substrate.

(iv) Even in the case of producing. It is possible to effectively produce an ink jet head having a prolonged ink discharging outlet face provided with a great many of discharging outlets arranged at a high arrangement density, it is possible to effectively and efficiently produce such ink jet head at a high yield.

(v) It is possible to produce a plurality of ink Jet heads at the same time by using a substrate for an ink jet, head produced by means of the semiconductor technique.

(vi) It is possible to form a liquid chamber having a higher height than the liquid pathway's height, and therefore, it is possible to mass-produce an ink jet head having a great many of fine nozzles.

By the way, as the substrate for an ink jet head, a silicon substrate is usually used. Such silicon substrate is usually quarried from a silicon wafer. The silicon wafer is in a round form and the size thereof is limited. And the number of the silicon substrate quarried from the silicon wafer is small. Hence, the silicon substrate is unavoidably costly. In view of this, there has been recently proposed the use of a metal substrate such as an aluminum substrate instead of the silicon substrate. The metal substrate has advantages such that the cost of a metal wafer from which the metal substrate is quarried is lower than that of the silicon wafer, the metal wafer can be easily made to be in a straight-sided form, the number of the metal substrate obtained from a metal wafer is greater than that of the silicon substrate obtained from a silicon wafer, and therefore, the cost of the metal substrate is markedly lower than that of the silicon substrate. However, in the case where such metal substrate is used in the production of an ink jet head, the difference between the linear expansion coefficient of the metal substrate and that of the liquid pathway-forming resin is apparently greater than that in the case of using the silicon substrate, and therefore, a serious problem is liable to entail when the metal substrate is accompanied with a warp. In order to eliminate this problem, the present inventors conceived to make the second substrate to be also a metal substrate. However, for this, it was found that there is a problem such that it is impossible to subject the hardening material to exposure in a state of the second substrate being contacted with the hardening material, and because of this, it is definitely necessary to laminate the second substrate to a previously patterned hardening material with the use of an adhesive. According to the present invention, the problem relative to the warp at the second substrate can be desirably eliminated, and it is possible to laminate the second metal substrate to the hardening material without using an adhesive.

Further, the present invention enables to produce a prolonged ink jet head usable in a dye printing system comprising a dye printing apparatus or a combination of a pre-treatment apparatus, dye printing apparatus and post-treatment, wherein a highly sophisticated print is stably provided. In addition, the present invention enables to produce an ink jet head usable in facsimile machines, copying machines, and printing machines.

Incidentally, when the present invention is applied particularly to an ink jet system for discharging ink by utilizing thermal energy, among various ink jet systems, the present invention provides pronounced advatages.

The typical construction and principle can be realized by using the fundamental principles, for example, disclosed in U.S. Pat. Nos. 4,723,129 and 4,740,796. Although the system can be applied to both a so-called "on-demand type" and "continuous type", it is more effective when the present invenntion is particularly applied to the on-demand type, because, by applying at least one drive signal corresponding to the print information and capable of providing the abrupt temperature.increase exceeding nucleate boiling to the electrical/thermal converting elements arranged in correspondence to the paper or liquid passages including the liquid (ink) therein, it is possible to form a bubble in the liquid (ink) in corresponding to the drive signal by generating the film boiling on the heat acting surface of the ink jet hand due to the generation of the thermal energy in the electrical/thermal converting elements. Due to the growth and contraction of the bubble, the liquid (ink) is discharged from discharge opening to form at least one ink droplet. When the drive signal has a pulse shape, since the growth and contraction of the bubble can be quickly effected, more excellent ink discharge is achieved. Such pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the ink Jet head, the present invention includes the construction wherein the heat acting portion is disposed in an arcuate area as disclosed in U.S. Pat. Nos. 4,558,333 and 4,459,600, as well as the constructions wherein the discharge openings, liquid passages and electrical/thermal converting elements are combined (straight liquid passages or orthogonal liquid passages). In addition, the present invention can applicable to the construction wherein each discharge opening is constituted by a slit with which a plurality of electrical/thermal converting elements associated in common as disclosed in the Japanese Patent Laid-Open No. 59-123670 and the construction wherein openings for absorbing the pressure wave of the thermal energy are arranged in correspondence to the discharge openings as disclosed in the Japanese Patent Laid-Open No. 59-138461.

Further, the present invention can be applied to a ink jet head of full-line type having a Length corresponding to a maximum width of a printing medium to be printed, as such ink jet head, the construction wherein such length is attained by combining a plurality of ink jet heads or a single ink jet head integrally formed may be adopted. In addition, the present invention is effectively applicable to a removable ink jet head of chip type wherein, when mounted on the ink jet system, electrical connection between it and the ink jet system and the supply of ink from the ink jet system can be permitted, or to an ink jet head of cartridge type wherein a cartridge is integrally formed with the head.

Further, it is preferable that a head recovering means and an auxiliary aiding means are added to the ink jet head according to the present invention, since the effect of the present invention is further improved. More concretely, these means include a capping means for capping the ink jet head, cleaning means, pressurizing or suction means, and an auxiliary heating means comprising electrical/thermal converters or other heating elements or the combination thereof. Further it is effective for the stable printing to perform an auxiliary discharge mode wherein the ink discharge regardless of the recording ink discharge is effected.

Further, as the printing mode of the printing system, the present invention can effectively be applied not only to a printing mode with a single main color such as black, but also to a system providing a plurality of different colors and/or a full-color by mixing colors by using an integrated ink jet head or the combination of plural ink jet heads.

Further, in the illustrated embodiments, while the ink is liquid, the ink may be solid in a room temperature or lsee, or may be softened at a room temperature. In the above-mentioned ink jet system, since the temperature control is generally effected in a temperature range from 30° C. to 70° C. so that the viscosity of the ink is maintained within a stable discharging range, the ink may be liquidized when the print signal is emitted. In addition, ink having a feature that Is firstly liquidized by the thermal energy, such as solid ink which surves to prevent the increase in temperature by absorbing energy in charging the ink from the solid state to the liquid state or which is in the solid state in the preserved condition to prevent the vaporization of ink and which is liquidized into ink liquid to be discharged in response to the print signal comprising the thermal energy, or ink which has already been solidified upon reaching the printing medium, can also be applied to the present invention. In such a case, the ink can be held in the liquid state or solid state in recesses or holes in porous sheet as disclosed in the Japanese Patent Laid-Open Nos. 54-56847 and 60-71260, in confronting relation to the electrical/thermal converters. In any case, in the present invention, the above-mentioned film boiling principle is most effective for each ink.

Figure 7:
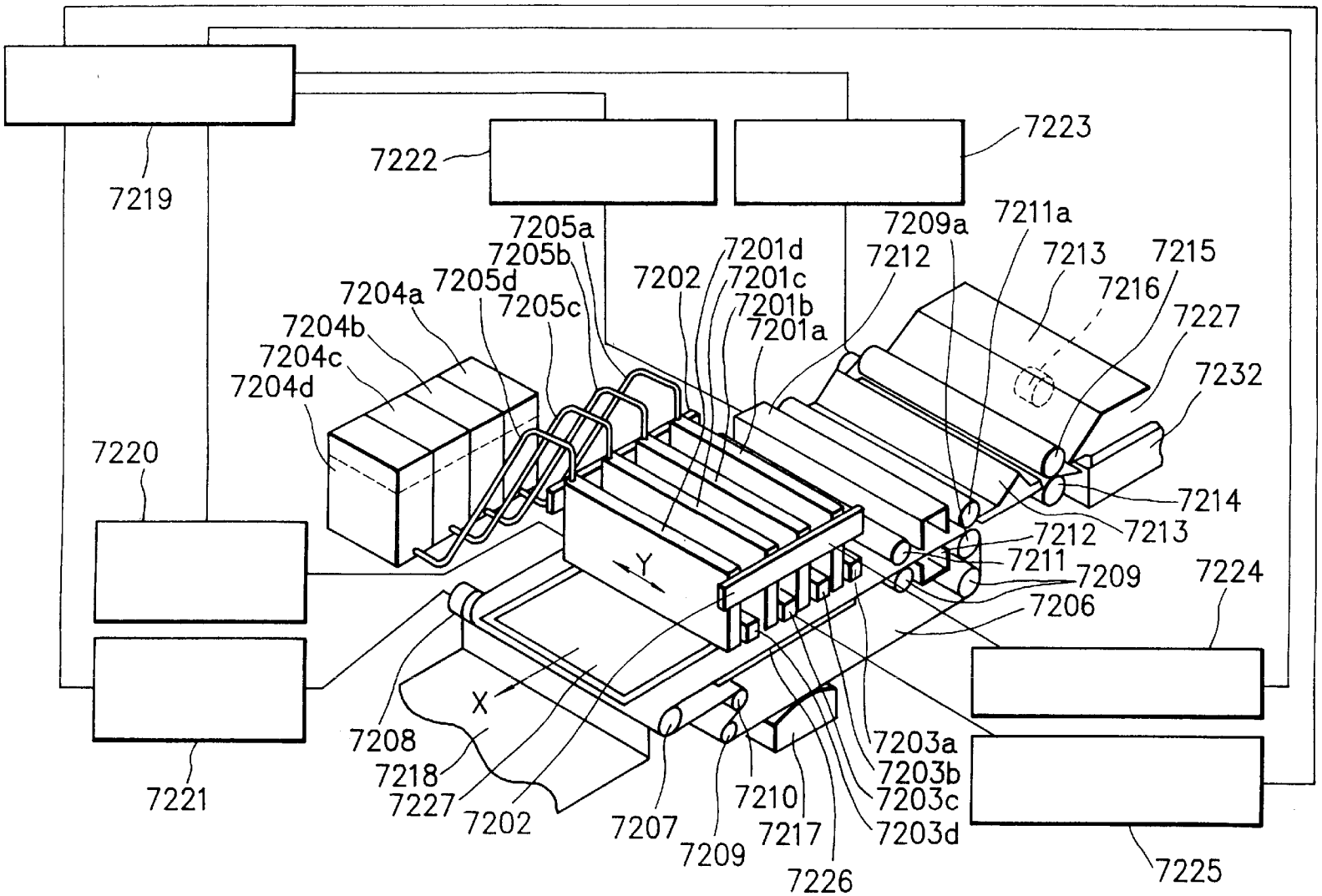
FIG. 7 is a schematic diagram of an example of an ink jet apparatus in which an ink jet head produced according to the present invention can be used.

FIG. 7 shows an ink jet apparatus in which an ink jet head according to the present invention can be used.

The ink jet apparatus shown in FIG. 7 is provided with line type heads 7201*a*–7201*d*, wherein the line type heads 7201*a*–7201*d* are fixed in parallel to each other at predetermined intervals in a X direction by a holder 7202. On the bottom surface of each head 7201*a*–7201*d*, 3456 discharging outlets are provided faced down at the intervals of 16 discharging outlets/mm in a line in Y direction to enable the printing over a width of 218 mm.

The heads 720l–7201*d* discharge liquid by thermal energy, and the discharge control is effected by a head driver 7220.

A head unit is constituted by the heads 7201*a*–7201*d* and the holder 7202, and the head unit Is movable up and down by a head moving means 7224.

Below the heads 7201*a*–7201*d*, head caps 7203*a*–7203*d* are disposed adjacent to the respective heads 7201*a*–7203*d* correspondingly thereto. Each head cap 7203*a*–7203*d* is provided with an ink absorption member such as sponge therein.

The caps 7203*a*–7203*d* are fixed by unshown holder. A cap unit is constituted by the holder and the caps 7203*a*–7203*d*. The cap unit is movable in the X direction by the cap moving means 7225.

To the heads 7201*a*–7201*d*, cyan, magenta, yellow, black inks are supplied from ink containers 7204*a*–7204*d* through ink supply tubes 7205*a*–7205*d*, respectively to permit color printing.

For the ink supply, capillary phenomenon at the head discharging outlet is used, and therefore, the liquid surface of the each ink container 7204*a*–7204*d* is lower than the dischariging outlet position by a constant distance.

This apparatus has an electrically chargeable seamless belt 7206 for transporting a printing material in the form of a printing paper 7227.

The belt 7206 is extended along a predetermined path by a driving roller 7207, idle rollers 7209, 7209*a* and a tension roller 7210, and is connected to the driving roller 7207. It is moved by a belt driving motor 7208 driven by a motor driver 7221.

The belt 7206 travels right below the discharging outlets of the heads 720*a*–7201*d*. In this embodiment, the downward deflection is suppressed by the fixed supporting member 7226.

Designated by reference numeral 7217 is a cleaning unit for removing paper dust or the like deposition on the surface of the belt 7206.

Designated by reference numeral 7212 is a charger for charging the charger, and the charger 7212 is rendered ON and OFF by a charger driver 7222. The printing paper is attracted on the belt 7206 by the electrostatic attraction force produced by the charging.

Before and after the charger 7212, there are provided pinch rollers 2111 and 2211*a* for cooperation with the idle rollers 7209 and 7209*a* to urge the transported printing paper 7227 to the belt 7206.

Designated by reference numeral 7232 is a sheet feeding cassette, a printing paper 7227 in which is fed out one by one by the rotation of the sheet feeding roller 7216 driven by the motor driver 7223, and is fed in the X direction to a wedge-shaped guide 7213 by a transportation roller 7214 and a pinch roller 7215 driven by the same driver 7223. The guide 7213 has a wedge-shaped space to permit deflection of the printing paper.

Designated by reference numeral 7218 is a sheet discharge tray for receiving the printing paper on which the printing has been completed.

The control circuit 7219 controls all of the head driver 7220, head moving means 7224, cap moving means 7225, motor driver 7221, 7223, and charger driver 7222.

In the following, the present invention will be described in more detail with reference to examples. It should be understood that these examples are only for the illustrative purposes but are not intended to restrict the scope of the present invention to these examples.

EXAMPLE 1

There was produced an ink jet head of the constitution shown in FIG. 1.

As the substrate 1 for an ink jet head, there was provided a substrate made of silicon which is provided with 128 electrothermal converting elements (that is, energy generating elements) capable of generating energy utilized for discharging ink, spacedly arranged at a predetermined equal interval thereon.

On the surface of the silicon substrate, a positive type photosensitive resin film OZATEC R255 (trademark name, manufactured by Hexist Japan Co.) was laminated at a temperature of 100° C. and at a pressure of 3 Kg/cm$^2$ to thereby form a 30 $\mu$m thick photosensitive resin layer on the energy generating element-bearing surface of the silicon substrate. A photo mask having a pattern for forming liquid pathways and a liquid chamber was superposed on the photosensitive resin layer, followed by subjecting to irradiation of ultraviolet rays of 70 mJ/cm$^2$ wherein a given area of the photosensitive resin layer not dedicating for the formation of liquid pathways and a liquid chamber was engaged in the irradiation of said ultraviolet rays, whereby a latent pattern dedicated for the formation of liquid pathways and a liquid chamber was formed in the photosensitive resin layer. The resultant was immersed in an aqueous solution containing 1 wt. % of NaOH as a developing solution to develop the latent pattern, followed by rinsing with pure water and to drying. By this, there was formed, on the energy generating element-bearing surface of the silicon substrate, a solid layer as the first solid layer 4 (see, FIG. 3) having a pattern capable of forming 128 liquid pathways each providing a discharging outlet of 30 $\mu$m×30 $\mu$m in size.

On the surface of a portion of the patterned first solid layer dedicated for the formation of a liquid chamber, a water-soluble solder resist TC-564-S-SN (trademark name, manufactured by San Nopco Limited) was applied by means of screen printing, followed by drying, whereby a 100 $\mu$m thick solid layer as the second solid layer 5 (see, FIG. 4) was formed on the patterned first solid layer.

Then, a glass plate provided with an opening serving as an ink supply port as the second substrate 7 (see, FIG. 5) was laminated onto the second solid layer at a reasonable pressure such that the opening of the glass plate was sufficiently sealed by the second solid layer, to thereby obtain a stacked body having a space (that is, the space 6' in FIG. 5) dedicated for the formation of circumferential walls of liquid pathways and a liquid chamber between the first and second substrates.

While the second substrate being pressed toward the first substrate, a resin composition composed of 73 parts by weight of an epoxy resin KRM-2410 (trademark name, manufactured by Asahidenka Kogyo Kabushiki Kaisha), 20 parts by weight of a plasticizer EPOLITE 3002 (trademark name, manufactured by Kyoeiyushi Kabushiki Kaisha), 2 parts by weight of a reaction initiator SP-170 (trademark name, manufactured by Asahidenka Kogyo Kabushiki Kaisha) and 5 parts by weight of a adhesion promotion agent A-187 (trademark name, manufactured by Nippon Unicar Kabushiki Kaisha) as the hardening material 6 (see, FIG. 6) was introduced into the space of the stacked body to thoroughly fill the space by the resin composition by means of a dispenser, followed by subjecting the stacked body having the resin composition filled in the space to exposure treatment by irradiating ultraviolet rays of 50 mJ/cm$^2$ to the stacked body through the second substrate thereof, whereby the first solid layer was solubilized and the resin composition was hardened.

The resultant was immersed in an aqueous solution containing 5 wt. % of NaOH to elute the first and second solid layers, followed by rinsing with pure water and to drying, to establish 128 liquid pathways each containing an energy generating element and having a discharging outlet and a liquid chamber, whereby an ink jet head was obtained.

In this way, there were produced 100 ink jet heads.

Of the resultant 100 ink jet heads, 10 ink jet heads were randomly selected. As for each of these 10 ink jet heads, its ink jet head performance was evaluated in the following manner. That is, each ink jet head was driven at a driving frequency of 7 kHz, wherein all the discharging outlets thereof were continuously dedicated for ink discharging for 100 A-4 sized printing papers. And as for the papers thus printed, their print states were optically observed. As a result, no irregular print was found as for any of the printed papers.

Based on the evaluated results, it was found that the process of the present invention enables to effectively produce a highly reliable ink jet head having an excellent in ink discharging performance at a high yield.

EXAMPLE 2

There was produced an ink jet head of the constitution shown in FIG. 1.

As the substrate 1 for an ink jet head, there was provided a substrate made of silicon which is provided with 128 electrothermal converting elements (that is, energy generating elements) capable of generating energy utilized for discharging ink, spacedly arranged at a predetermined equal interval thereon.

On the surface of the silicon substrate, a positive type photosensitive resin PMER AR-900 (trademark name, manufactured by Tokyo Ohka Kabushiki Kaisha) was applied in an amount to provide a thickness of 30 $\mu$m when dried by means of the spin coating process, followed by subjecting to heat treatment at 90° C. for 40 minutes in an oven, to thereby form a 30 $\mu$m thick photosensitive resin layer on the energy generating element-bearing surface of the silicon substrate. A photo mask having a pattern for forming liquid pathways and a liquid chamber was superposed on the photosensitive resin layer, followed by subjecting to irradiation of ultraviolet rays of 70 mJ/cm$^2$ wherein a given area of the photosensitive resin layer not dedicating for the formation of liquid pathways and a liquid chamber was engaged in the irradiation of said ultraviolet rays, whereby a latent pattern dedicated for the formation of liquid pathways and a liquid chamber was formed in the photosensitive resin layer. The resultant was immersed in an aqueous solution containing 1 wt. % of NaOH as a developing solution to develop the latent pattern, followed by rinsing with pure water and to drying. By this, there was formed, on the energy generating element-bearing surface of the silicon substrate, a solid layer as the first solid layer 4 (see, FIG. 3) having a pattern capable of forming 128 liquid pathways each providing a discharging outlet of 30 $\mu$m×30 $\mu$m in size.

On the surface of a portion of the patterned first solid layer dedicated for the formation of a liquid chamber, a plating resist MA-830 (trademark name, manufactured by Taiyo Ink Kabushiki Kaisha) was applied by means of screen printing, followed by drying while removing the solvent, whereby a 100 $\mu$m thick solid layer as the second solid layer 5 (see, FIG. 4) was formed on the patterned first solid layer.

Then, a glass plate provided with an opening serving as an ink supply port as the second substrate 7 (see, FIG. 5) was laminated onto the second solid layer at a reasonable pressure such that the opening of the glass plate was sufficiently sealed by the second solid layer, to thereby obtain a stacked body having a space (that is, the space 6' in FIG. 5) dedicated for the formation of circumferential walls of liquid pathways and a liquid chamber between the first and second substrates.

While the second substrate being pressed toward the first substrate, a thermosetting resin composition composed of 50 parts by weight of a bisphenol A type epoxy resin EPICOTE 828 (trademark name, manufactured by Yuka Shell Kabushiki Kaisha), 48 parts by weight of a modified aromatic amine hardener FUJICURE XK-83 (trademark name, manufactured by Fujikasei Kogyo Kabushiki Kaisha), and 2 parts by weight of an epoxy series silane coupling agent A-187 (trademark name, manufactured by Nippon Unicar Kabushiki Kaisha) as the hardening material 6 (see, FIG. 6) was introduced into the space of the stacked body to thoroughly fill the space by the resin composition by means of a dispenser, followed by allowing to stand the resin composition filled in the space of the stacked body at 25° C. for 24 hours and subjecting the resin composition to heat treatment at 100° C. for 2 hours to harden it.

The resultant was immersed in a solvent comprising acetone to elute the first and second solid layers, followed by rinsing with pure water and to drying, to establish 128 liquid pathways each containing an energy generating element and having a discharging outlet and a liquid chamber, whereby an ink jet head was obtained.

In this way, there were produced 100 ink jet heads. Of the resultant 100 ink jet heads, 10 ink jet heads were randomly selected. As for each of these 10 ink jet heads, its ink jet head performance was evaluated in the following manner. That is, each ink jet head was driven at a driving frequency of 7 kHz, wherein all the discharging outlets thereof were dedicated for ink discharging to A-4 sized printing papers. And as for the papers subjected to the printing, their print states were optically observed. As a result, no irregular print was found as for each of the printed papers.

Based on the evaluated results, it was found that the process of the present invention enables to effectively produce a highly reliable ink jet head having an excellent in ink discharging performance at a high yield.

EXAMPLE 3

Figure 8:
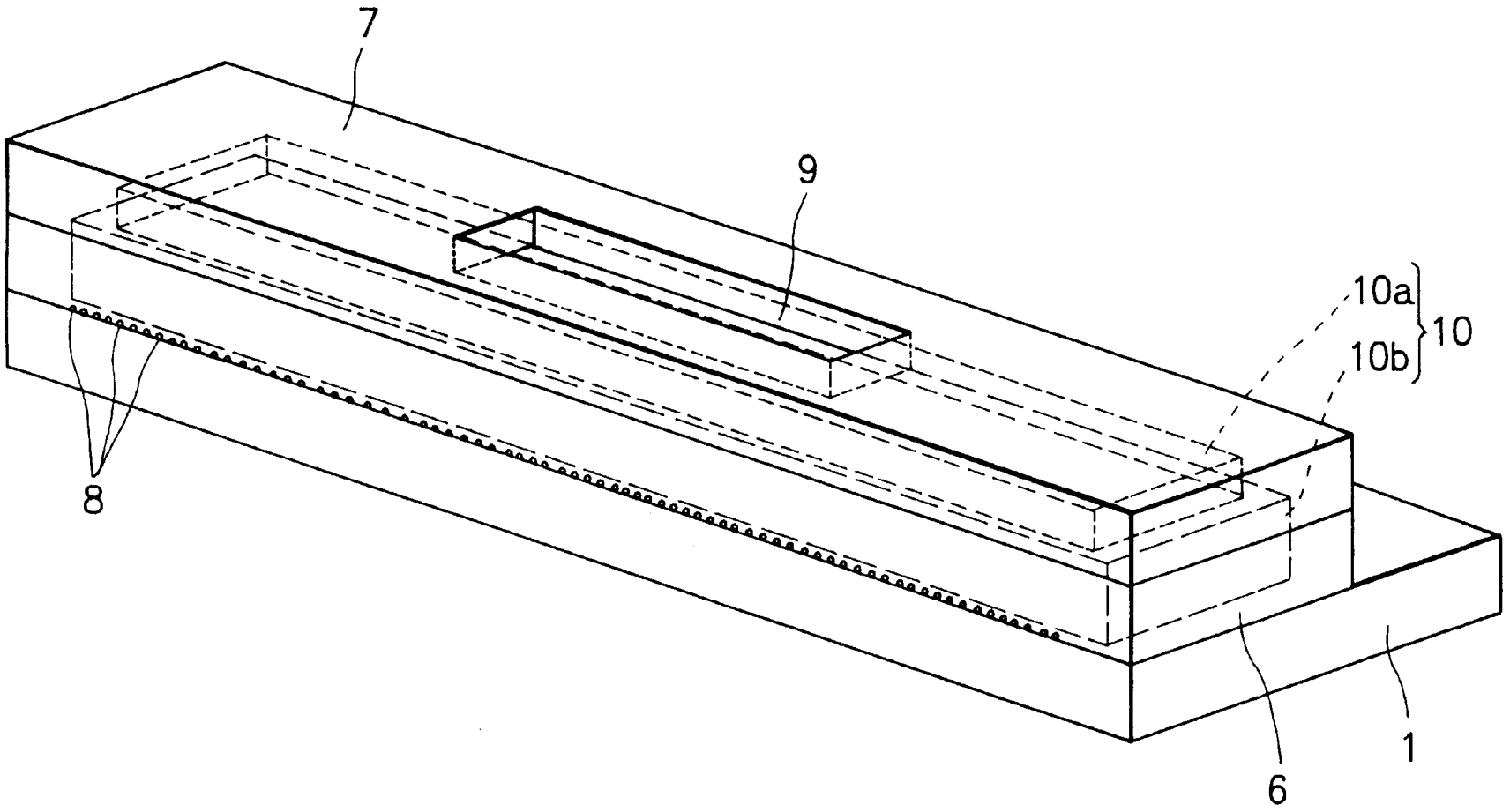
FIG. 8 a schematic perspective view illustrating an example of a long ink jet head having a prolonged discharging outlet face produced according to the present invention.

There was produced a long ink jet head having a prolonged discharging outlet face as shown in FIG. 8. In FIG. 8, the constitution is simplified for the simplification purposes, and reference numeral 10 schematically indicates a liquid chamber comprising a space 10*b* based on a first solid layer and a space 10*a* based on a second solid layer.

As the substrate 1 for an ink jet head, there was provided a long substrate made of aluminum which is provided with 3456 electrothermal converting elements (that is, energy generating elements) capable of generating energy utilized for discharging ink, spacedly arranged at an equal interval thereon.

On the surface of the aluminum substrate, a positive type photosensitive resin PMER AR-900 (trademark name, manufactured by Tokyo Ohka Kabushiki Kaisha) was applied in an amount to provide a thickness of 30 $\mu$m when dried by means of the spin coating process, followed by subjecting to heat treatment at 90° C. for 40 minutes in an oven, to thereby form a 30 m thick photosensitive resin layer on the energy generating element-bearing surface of the aluminum substrate. A photo mask having a pattern for forming liquid pathways and a liquid chamber was superposed on the photosensitive resin layer, followed by subjecting to irradiation of ultraviolet rays of 70 mJ/cm$^2$ wherein a given area of the photosensitive resin layer not dedicating for the formation of liquid pathways and a liquid chamber was engaged in the irradiation of said ultraviolet rays, whereby a latent pattern dedicated for the formation of liquid pathways and a liquid chamber was formed in the photosensitive resin layer. The resultant was immersed in an aqueous solution containing 1 wt. % of NaOH as a developing solution to develop the latent pattern, followed by rinsing with pure water and to drying. By this, there was formed, on the energy generating element-bearing surface of the aluminum substrate, a solid layer as the first solid layer 4 (see, FIG. 3) having a pattern capable of forming 3456 discharging outlets of 30 $\mu$m×30 $\mu$m in size at an arrangement density of 16 discharging outlets/mm.

On the surface of a portion of the patterned first solid layer dedicated for the formation of a liquid chamber, a UV hardening type acrylic resin TH-700T (trademark name, manufactured by Somal Kabushiki Kaisha) was applied by means of screen printing, followed by drying while removing the solvent, whereby a 100 um thick solid layer as the second solid layer 5 (see, FIG. 4) was formed on the patterned first solid layer.

Then, a long aluminum plate provided with an opening serving as an ink supply port and a recess communicated to said opening and which serves to form a part of a liquid chamber was provided as the second substrate 7 (see, FIG. 5). This aluminum second substrate was laminated onto the second solid layer at a reasonable pressure such that not only the opening but also the recess were sufficiently sealed by the second solid layer, to thereby obtain a stacked body having a space (that is, the space 6' in FIG. 5) dedicated for the formation of circumferential walls of liquid pathways and a liquid chamber between the first and second substrates.

While the second substrate being pressed toward the first substrate, a thermosetting resin composition composed of 50 parts by weight of a bisphenol A type epoxy resin EPICOTE 828 (trademark name, manufactured by Yuka Shell Kabushiki Kaisha), 48 parts by weight of a modified aromatic amine hardener FUJICURE XK-83 (trademark name, manufactured by Fujikasei Kogyo Kabushiki Kaisha), and 2 parts by weight of an epoxy series silane coupling agent A-187 (trademark name, manufactured by Nippon Unicar Kabushiki Kaisha) as the hardening material 6 (see, FIG. 6) was introduced into the space of the stacked body to thoroughly fill the space by the resin composition by means of a dispenser, followed by allowing to stand the resin composition filled in the space of the stacked body at 25° C. for 24 hours and subjecting the resin composition to heat treatment at 100° C. for 2 hours to harden it.

The resultant was immersed in an aqueous solution containing 5 wt. % of NaOH to elute the first and second solid layers, followed by rinsing with pure water and to drying, to establish 3456 liquid pathways each containing an energy generating element and having a discharging outlet and a liquid chamber, whereby a long ink jet head having a prolonged discharging outlet face was obtained.

In this way, there were produced 100 long ink jet heads. Of the resultant 100 ink jet heads, 10 ink jet heads were randomly selected. As for each of these 10 ink jet heads, its ink jet head performance was evaluated in the following manner. That is, each ink jet head was driven at a driving frequency of 7 kHz, wherein all the discharging outlets thereof were dedicated for ink discharging to A-4 sized printing papers. And as for the papers subjected to the printing, their print states were optically observed. As a result, no irregular print was found as for each of the printed papers.

Based on the evaluated results, it was found that the process of the present invention enables to effectively produce a highly reliable ink jet head having an excellent in ink discharging performance at a high yield, even in the case where a metal substrate for an ink jet head and a metal top plate are used.

What is claimed is:

1. A process for producing an ink jet head including a plurality of ink discharging outlets, a substrate for an ink jet head including a plurality of energy generating elements for generating energy utilized for discharging ink from said ink discharging outlets, a plurality of ink pathways aligned with said energy generating elements and communicated with said ink discharging outlets, and a liquid chamber for storing and supplying said ink into said ink pathways, said process comprising the steps of:

providing a first substrate as said substrate which is provided with said energy generating elements, said first substrate having a surface; and a second substrate having an opening serving to supplying said ink to said liquid chamber;

forming on said first substrate a first solid layer having a pattern for forming said ink pathways while utilizing the surface of said first substrate as bottom walls for said ink pathways, forming on said first solid layer a second solid layer having a pattern for forming said liquid chamber;

laminating said second substrate on said first substrate having said first and second solid layers thereon such that said opening of said second substrate is sealed by said second solid layer, to thereby obtain a stacked body having a space for forming circumferential walls for said ink pathways and said liquid chamber;

filling said space with a hardening material;

hardening said hardening material; and dissolving said first and second solid layers of said stacked body to remove the first and second solid layers, whereby forming said liquid chamber and said ink supplying pathways of providing said ink discharging outlets.

2. The process according to claim 1, wherein the first solid layer is composed of a resin.

3. The process according to claim 2, wherein the resin for the first solid layer is a positive type photosensitive resin.

4. The process according to claim 3, the pattern of the first solid layer is formed by way of photolithography.

5. The process according to claim 2, wherein the pattern of the first solid layer is formed by way of photolithography.

6. The process according to claim 1, wherein the second solid layer is composed of a resin.

7. The process according to claim 6, wherein the second solid layer is formed by means of printing process.

8. The process according to claim 7, wherein the printing process is screen printing process.

9. The process according to claim 1, wherein the hardening material is a thermosetting resin.

10. The process according to claim 1, wherein the hardening material is a photo-setting resin.

11. The process according to claim 10, wherein the second substrate is composed of a material having a property of allowing light having a wavelength of 300 to 500 nm to transmit therethrough, and light irradiation is conducted over the second substrate to harden the photosetting resin.

12. The process according to claim 1, wherein the opening of the second substrate includes a recess formed at the surface of the second substrate to be contacted with the surface of the second solid layer.

13. The process according to claim 1, wherein the first substrate is comprised of a metallic material.

14. The process according to claim 13, wherein the metallic material is aluminum.

15. The process according to claim 1, wherein the second substrate is comprised of a metallic material.

16. The process according to claim 15, wherein the metallic material is aluminum.

17. The process according to claim 1, wherein the first substrate is comprised of a metallic material and the second substrate is comprised of a metallic material.

18. The process according to claim 17, wherein the metallic material for the first substrate is aluminum and the metallic material for the second substrate is aluminum.

19. The process according to claim 1, wherein the ink jet head is a full-line type ink jet head having an ink discharging outlet face of a length exceeding a printing width of a printing member.

* * * * *

UNITED STATES PATENT AND TRADEMARK OFFICE

CERTIFICATE OF CORRECTION

PATENT NO. : 5,916,452
DATED : June 29, 1999
INVENTOR(S) : Junichi Kobayashi et al.

It is certified that error appears in the above-identified patent and that said Letters Patent is hereby corrected as shown below:

Column 1:
Line 44, "patterning" should read --to patterning--;
Line 53, "However,." should read --However,--; and
Line 57, "adhesive," should read --adhesive;--.

Column 2:
Line 33, "patterning," should read --patterning;--.

Column 3:
Line 19, "ink" should be deleted;
Line 35, "2 however" should read --2, however,--; and "making" should read --causing--; and
Line 37, "capable" should read --capable of--.

Column 4:
Line 7, "be not" should read --not be--;
Line 13, "5,3332,466" should read --5,332,466--; and
Line 42, "toward to" should read --toward--.

Column 5:
Line 8, "eliminated" should read --eliminate--; and
Line 57, "port to" should read --port--.

Column 6:
Line 4, "8 a" should read --8 is a--;
Line 10, "is," should read --is, the purpose of--;
Line 42, "filing" should read --filling--;
Line 47, "whereby" should read --thereby--; and
Line 48, "of providing" should read --providing--.

Column 8:
Line 4, "to" (first occurrence) should be deleted, and
Line 45, "pronounced" should read --various pronounced--.

UNITED STATES PATENT AND TRADEMARK OFFICE

CERTIFICATE OF CORRECTION

PATENT NO. : 5,916,452
DATED : June 29, 1999
INVENTOR(S) : Junichi Kobayashi et al.

It is certified that error appears in the above-identified patent and that said Letters Patent is hereby corrected as shown below:

Column 9:
Line 26, "serving.to" should read --serving to--; and
Line 36, "to to" should read --to--.

Column 10:
Line 10, "as as" should read --as--;
Line 20, "cased" should read --caused--;
Line 37, "4," should read --4 is comprised,--;
Line 40, "at later" (second occurrence) should be deleted;
Line 64, "4," should read --4 is comprised,--; and
Line 67, "fist" should read --first--.

Column 11:
Line 28, "contained" should read --containing--.

Column 12:
Line 21, "of the" should be deleted.

Column 13:
Line 23, "of" should be deleted--;
Line 38, "susbtrate." should read --substrates.--;
Line 39, "producing. It" should read --producing, it--;
Line 42, "of" should be deleted--;
Line 46, "Jet" should read --jet--; and
Line 47, "Jet," should read --jet--.

Column 14:
Line 32, "advatages." should read --advantages.--;
Line 38, "invenntion" should read --invention--;
Line 41, "temperature.increase" should read --temperature increase--;
Line 47, "hand" should read --head--;
Line 59, "Jet" should read --jet--; and
Line 66, "can" should read --can be--.

UNITED STATES PATENT AND TRADEMARK OFFICE

CERTIFICATE OF CORRECTION

PATENT NO. : 5,916,452
DATED : June 29, 1999
INVENTOR(S) : Junichi Kobayashi et al.

It is certified that error appears in the above-identified patent and that said Letters Patent is hereby corrected as shown below:

Column 15:
Line 38, "lsee," should read --less,--;
Line 45, "Is" should read --is--; and
Line 46, "surves" should read --serves--.

Column 16:
Line 3, "7201-7201d" should read --7201a-7201d--;
Line 6, "Is" should read --is--;
Line 23, "the each" should read --each--;
Line 24, "dischariging" should read --discharging--;
Line 34, "720a-7201d" should read --7201a-7201d--; and
Line 46, "2111 and 2211a" should read --7211 and 7211a--.

Column 17:
Line 20, "dedicating" should read --dedicated--;
Line 28, "to drying." should read --drying.--; and
Line 49, "being" should read --is being--.

Column 18:
Line 3, "to drying," should read --drying,--;
Line 20, "in ink" should read --ink--;
Line 45, "dedicating" should read --dedicated--; and
Line 53, "to drying." should read --drying.--.

Column 19:
Line 7, "being" should read --is being—;
Line 25, "to drying," should read --drying,--;
Line 41, "in ink" should read --ink--; and
Line 64, "30 m" should read --30 μm--;

Column 20:
Line 4, "dedicating" should read --dedicated--;
Line 11, "to drying." should read --drying.--;

UNITED STATES PATENT AND TRADEMARK OFFICE

CERTIFICATE OF CORRECTION

PATENT NO. : 5,916,452
DATED : June 29, 1999
INVENTOR(S) : Junichi Kobayashi et al.

It is certified that error appears in the above-identified patent and that said Letters Patent is hereby corrected as shown below:

Column 20 contd:
Line 22, "100 um" should read --100 μm--;
Line 36, "being" should read --is being--; and
Line 54, "to drying," should read --drying,--.

Column 21:
Line 6, "in ink" should read --ink--;
Line 42, "whereby" should read --thereby--; and
Line 43, "of providing" should read --providing--.

Column 22:
Line 3, "3, the" should read --3, wherein the--.

Signed and Sealed this

Third Day of July, 2001

Nicholas P. Godici

*Attest:*

*Attesting Officer*

NICHOLAS P. GODICI
*Acting Director of the United States Patent and Trademark Office*